US007878388B2

(12) United States Patent
Dailey

(10) Patent No.: US 7,878,388 B2
(45) Date of Patent: Feb. 1, 2011

(54) APPARATUS AND METHOD FOR USING A THREE DIMENSIONAL FLIP-FLOP POSTCARD

(76) Inventor: Joel R. Dailey, 333 Buck Smith Rd., Leesville, SC (US) 29070

( * ) Notice: Subject to any disclaimer, the term of this patent is extended or adjusted under 35 U.S.C. 154(b) by 1082 days.

(21) Appl. No.: 11/611,604

(22) Filed: Dec. 15, 2006

(65) Prior Publication Data

US 2007/0138241 A1 Jun. 21, 2007

Related U.S. Application Data

(60) Provisional application No. 60/597,668, filed on Dec. 16, 2005.

(51) Int. Cl.
*B42D 15/00* (2006.01)
*A43B 3/12* (2006.01)

(52) U.S. Cl. ..... 229/92.8; 36/11.5

(58) Field of Classification Search ..... 229/92.8; 36/11.5

See application file for complete search history.

(56) References Cited

U.S. PATENT DOCUMENTS

| | | | | | |
|---|---|---|---|---|---|
| 2,119,233 | A * | 5/1938 | Judkins | 36/11.5 |
| 3,346,172 | A * | 10/1967 | Tucker | 229/92.8 |
| 4,055,690 | A * | 10/1977 | Patterson | 428/9 |
| 4,928,831 | A * | 5/1990 | Kirsch | 206/575 |
| 5,010,669 | A * | 4/1991 | Moran | 40/539 |
| 5,118,031 | A | 6/1992 | Tighe | |
| 5,163,608 | A * | 11/1992 | Block | 229/92.8 |
| 5,735,453 | A * | 4/1998 | Gick et al. | 229/92.8 |
| 5,855,396 | A | 1/1999 | Simpson-Jones | |
| 6,442,869 | B2 | 9/2002 | Coomes | |
| 6,516,538 | B2 | 2/2003 | Kraft | |
| 6,615,516 | B1 * | 9/2003 | Houston et al. | 40/124.01 |
| 6,792,697 | B2 * | 9/2004 | Wright et al. | 36/11.5 |
| 2007/0205254 | A1 * | 9/2007 | Philbrick | 229/92.8 |
| 2008/0124684 | A1 * | 5/2008 | Grell | 434/81 |

FOREIGN PATENT DOCUMENTS

WO WO 9317410 A1 * 9/1993

* cited by examiner

*Primary Examiner*—Jes F Pascua
(74) *Attorney, Agent, or Firm*—Calhoun Thomas, III; Samuel Alexander Long, Jr.

(57) ABSTRACT

The invention is a postcard in the form of a lightweight flip-flop sandal. This postcard is an efficient and unique way to memorialize and to convey the leisure experiences of the sender to an addressee. The three-dimensional flip-flop postcard can actually be worn, albeit without a mate unless two are sent, either before or after a message and appropriate address information is written in applicable marking areas and it is mailed with sufficient postage or otherwise delivered to the intended recipient.

4 Claims, 2 Drawing Sheets

APPARATUS AND METHOD FOR USING A THREE DIMENSIONAL FLIP-FLOP POSTCARD

RELATED APPLICATION

This application is filed pursuant to US Provisional Patent Application having Application No. 60/597,668 filed on Dec. 16, 2005.

FEDERALLY SPONSORED RESEARCH OR DEVELOPMENT

Not applicable.

REFERENCED OR INCORPORATED MATERIAL

Not applicable.

BACKGROUND OF INVENTION

The present invention relates to postcards, particularly those postcards associated with the tourism industry. Rather than the traditional two dimensional rectangular cardstock postcard, the present invention relates to a true-size three dimensional functional flip-flop postcard.

Certainly the idea of a postcard as an efficient mailer is quite old in the art. Over the years, postcards have particularly grown as a method of correspondence in travel and the tourism industry. It is presently quite common to find postcards for sale at tourist destinations. Most postcards are rectangular in shape and are typically made out of efficient lightweight cardstock. They often feature a photo or other identifiable greeting on one side and a place for postal markings and brief personal note on the reverse. Typically the postcard sender picks a card with an image of a place or thing that he or she has recently seen or experienced. Often this is done with the goal of imparting to the recipient the idea of the sender being relaxed and on vacation.

In the art of footwear, and particularly in the open sandal portion of that art, the flip-flop has likewise been well known as an item of leisure wear for many years. The flip-flop is known in the art for its lightweight, efficient construction and for its ease of use. Typically, a flip-flop is constructed of a lightweight sole and some sort of strap or thong thereon attached into which the foot is able to contact and to grip the flip-flop. It is presently quite common to find flip-flops in use and on sale in beach and other outdoor leisure settings. Such settings may also frequently be tourist destinations.

Thus, postcards and flip-flops have separately coexisted for a great many years in tourist and other leisure venues, and yet, no prior art appears to exist that encompasses or even suggests the present invention.

SUMMARY OF THE INVENTION

The present invention relates to a postcard constructed in a functional flip-flop design whereby the user could actually wear the flip-flop, then take it off of his foot, write a message on one side, affix postage such as one or more stamps and an address on the other side, and, finally, place it in the postal mail system to send it to a relative, friend, or other recipient.

It is an object of the present invention to respond to a long felt need in the art of postcards to impressionably convey to a postcard addressee the unique vacation or similar experiences of the postcard sender. The present invention recognizes this need by combining the iconic flip-flop, so commonly associated with leisure activities, with the message conveyance and the efficient utility of a postcard. As a postcard, the present invention quickly, efficiently, and even humorously suggests to the recipient that the sender is relaxing in a leisurely location where you might typically find flip-flops such as a beach vacation destination or similar place.

Another aspect of the present invention which relates to its utility is its weight. The present invention contemplates a lightweight construction to facilitate mailing of the flip-flop postcard. Flip-flops are very often made of lightweight materials such as foam rubber. Thus, by achieving a light weight, the postal expenses associated with the mailing of this postcard experience will be relatively inexpensive.

DETAILED DESCRIPTION

It is to be understood by a person having ordinary skill in the art that the present discussion is a description of exemplary embodiments only, and is not intended as limiting the broader aspects of the present invention. The following example is provided to further illustrate the invention and is not to be construed to unduly limit the scope of the invention.

The preferred embodiment of the present invention generally contemplates a flip-flop postcard that could be a functional flip-flop for the sender or recipient, however it is not an object of this invention that the postcard actually be used as a flip-flop. The postcard comprises a sole 10, a strap or thong firmly attached thereto 30, and an assortment of marking surfaces 20, 40, & 60 affixed on either side or on both of them. In the preferred embodiment, the marking surfaces 20, 40, & 60 are recessed into the sole 10 of the flip-flop. These recessed surfaces 20, 40, & 60 can be seen via the cross-section in FIG. 2.

Figure 1:
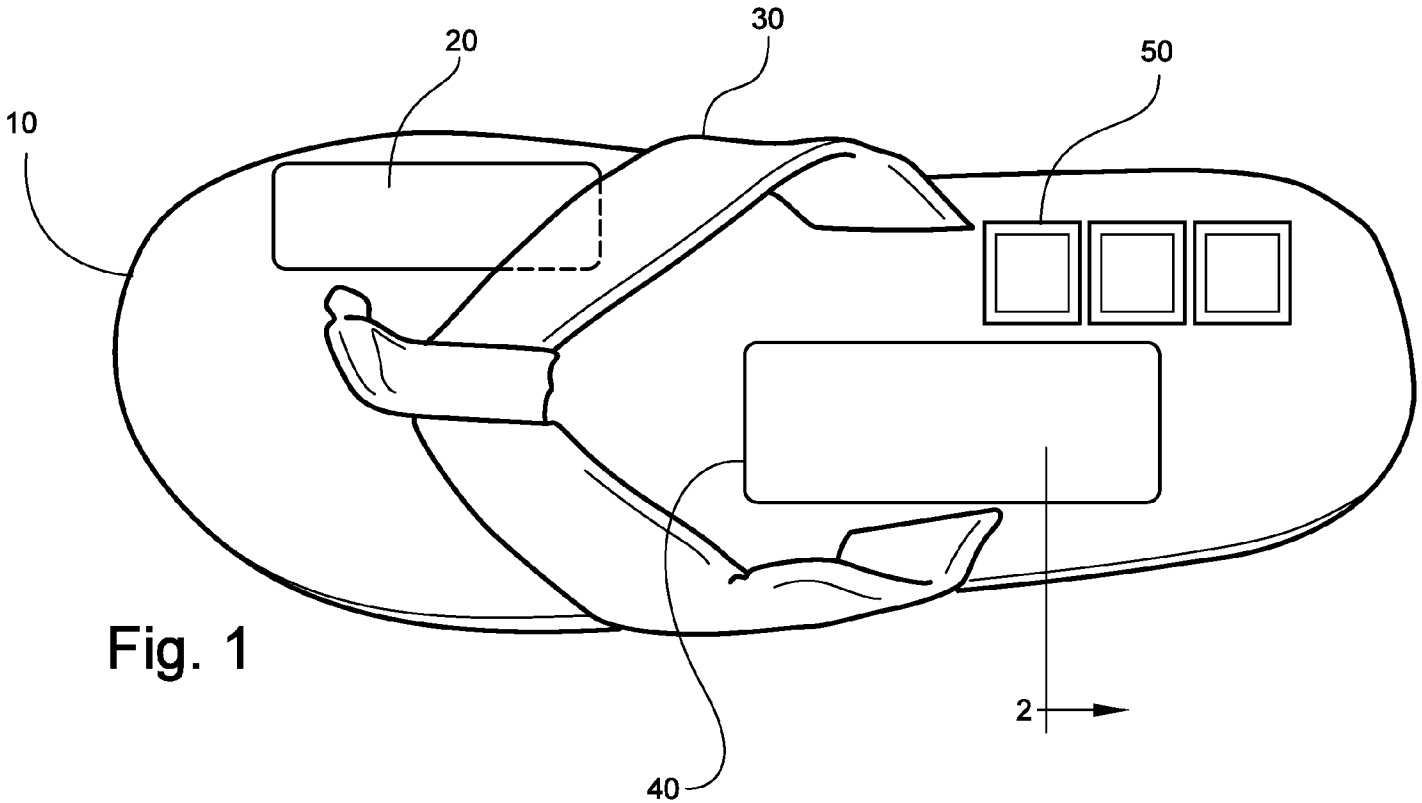
FIG. 1 is a top view of an embodiment showing a strap and marking and postal attachment surfaces.
Figure 2:
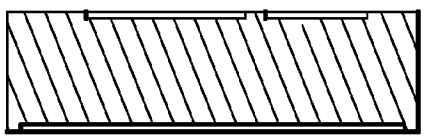
FIG. 2 is a cross-section of FIG. 1 showing an embodiment that has recessed marking and postal attachment surfaces.
Figure 4:
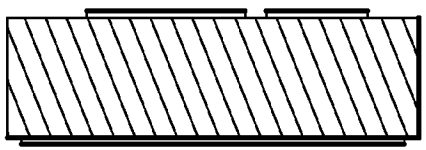
FIG. 4 is a cross-section of FIG. 1 showing an embodiment that has raised marking and postal attachment surfaces.

An alternate embodiment has the marking surfaces 20, 40, & 60 not recessed as in FIG. 2, but instead raised above the level of the flip-flop sole 10 as is shown in FIG. 4 which is a cross-section of FIG. 1.

The sole 10 is made of lightweight material, such as the dense foam rubber typically used in flip-flop construction. The sole 10 constitutes the main body of the post card and further could function as the sole of a flip-flop. The sole 10 is characterized by a top portion which is the top side where the foot touches when worn and a bottom portion which is the bottom side that contacts the earth when worn. The overall sole 10 is relatively planar and the thickness of the sole 10, though generally uniform, can vary considerably depending on design preferences. The shape is approximately that of a human foot or of a traditional shoe.

The strap or thong 30, as is common in the flip-flop art, is attached to the sole 10 in at least two, though typically in three, places. The strap 30 extends above the top portion of the sole 10. The strap 30 is constructed of lightweight materials that can include a broad range of materials like plastics and natural fibers. The points of attachment to the sole 10 are such that a foot can easily slide in and yet remain in contact with the sole 10 in order to grip the flip-flop. Often the strap 30 will be made of a fabric such that it can lie generally flat against the sole 10 and thus minimize the apparent thickness of the apparatus. This flattening of the strap or thong 30 can improve postal handling and further convey the postcard image.

Figure 3A:
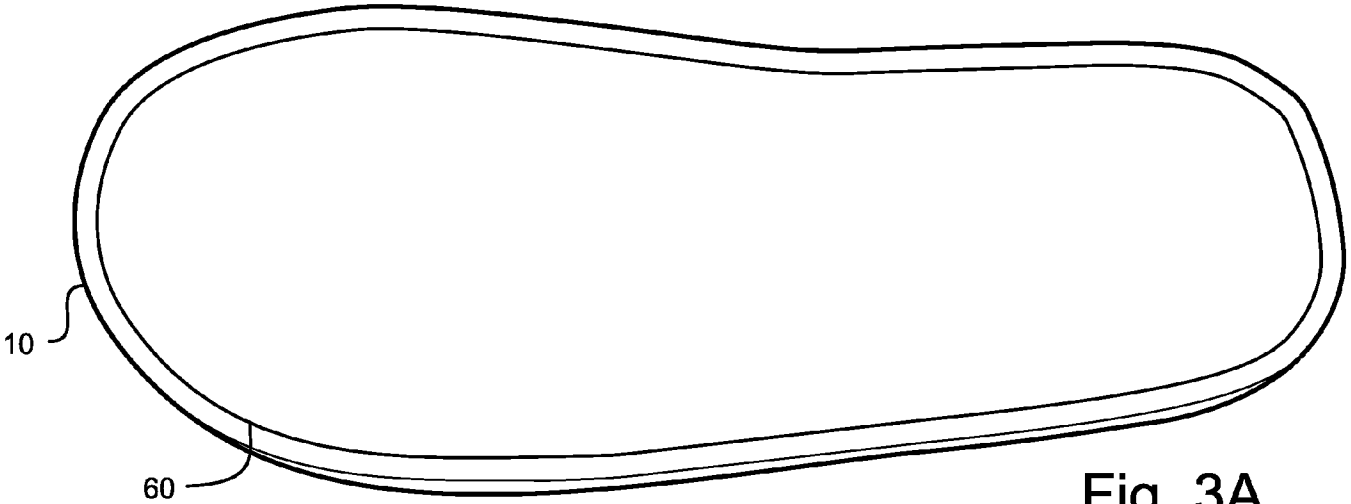
FIG. 3A is a bottom view of an embodiment showing a blank marking surface.
Figure 3B:
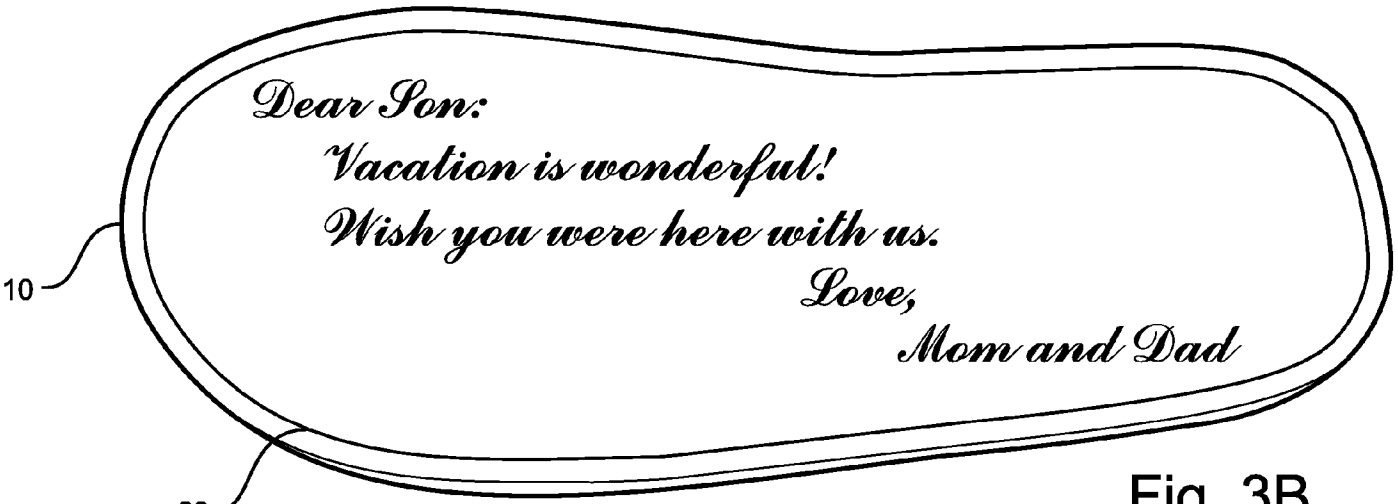
FIG. 3B is a bottom view of an embodiment showing a marking surface which has been inscribed with a message.

Also, an assortment of marking surfaces 20, 40, & 60 are attached to the sole 10 or incorporated into the sole material. In the preferred embodiment, the marking surfaces 20, 40, & 60 are recessed into the sole 10 of the flip-flop. The recessed surfaces can be seen via the cross-section in FIG. 2 and the alternative raised surfaces can bee seen in the cross-section in FIG. 4. These surfaces 20, 40, & 60 can be attached or incorporated in any number of ways such as through adhesive application. The surfaces 20, 40, & 60 are designed so that the sender can write or otherwise print a short message and appropriate postal address information for the intended recipient. In one embodiment, a marking surface 60 is fixed to the bottom portion of the sole 10 for the message to be inscribed by the sender. FIG. 3A shows this marking surface 60 with no markings yet inscribed and FIG. 3B shows the marking surface 60 with the marking surface inscribed.

In this embodiment, other marking surfaces 40 & 20 are attached to the top portion of the sole for the address 20 and return address 40 to be inscribed by the sender. There is also sufficient space 50 on the top portion for appropriate postal stamps to be affixed. Often the postage 50, address 40, and return address 20 spaces are located on one side of the flip-flop and the message space 60 is located on the other side, however this is not a requirement that they be on opposite sides. Additionally, in some embodiments the marking surfaces 20, 40, & 60 may be pre-filled out with information such as the location of the place where the sender obtained the flip-flop postcard. This can be beneficial by both reducing the information that the sender must write on the postcard and by acting as a source of advertising for the place where the present invention is being sold.

Another element of the invention relates to decorative or ornamental identifiers or setting elements that may be attached to the sole or straps or the present invention. Such identifiers or setting elements, if added, would be indicative of or unique to the particular environment where the postcard invention would be marketed and sold. For an embodiment contemplating a beach setting, for instance, the identifiers or setting elements might include affixed images or miniatures of typical beach items like a beach ball or sun glasses or perhaps a photographic image or name of the particular beach or similar location. These identifiers or setting elements enable this embodiment of the present invention to more immediately convey a vacation-themed message.

What is claimed is:

1. A three dimensional flip-flop post card apparatus comprising:

a sole, wherein said sole is planar and has a uniform thickness and further comprises a top side and a bottom side;

a foot strap fixedly attached to said sole; and a plurality of marking surfaces disposed on said sole and recessed into said sole for inscribing a written message and appropriate postal identifications.

2. The three dimensional flip-flop post card apparatus of claim 1 wherein a postal stamp surface is disposed on said top side of the sole and said plurality of marking surfaces are attached on both the top side of the sole and the bottom side of the sole.

3. The three dimensional flip-flop post card apparatus of claim 1 wherein said foot strap is fixedly attached to said sole at more than one point on the sole.

4. The three dimensional flip-flop post card apparatus of claim 1 wherein said sole is made of a dense lightweight foam rubber.

* * * * *